US007393053B2

(12) United States Patent
Kurrasch et al.

(10) Patent No.: US 7,393,053 B2
(45) Date of Patent: Jul. 1, 2008

(54) OFFICE COMPONENTS, SEATING STRUCTURES, METHODS OF USING SEATING STRUCTURES, AND SYSTEMS OF SEATING STRUCTURES

(75) Inventors: Andrew J. Kurrasch, Saugatuck, MI (US); Robert L. Beck, Zeeland, MI (US); Daniel Robert Kuiper, Zeeland, MI (US); Arturo J. Bonomie, Spring Lake, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 11/649,179

(22) Filed: Jan. 3, 2007

(65) Prior Publication Data

US 2007/0108809 A1 May 17, 2007

Related U.S. Application Data

(62) Division of application No. 10/627,354, filed on Jul. 24, 2003, now Pat. No. 7,163,263.

(60) Provisional application No. 60/398,514, filed on Jul. 25, 2002.

(51) Int. Cl.

| | |
|---|---|
| ***A47C 3/026*** | (2006.01) |
| ***A47C 1/02*** | (2006.01) |
| ***A47C 1/024*** | (2006.01) |
| ***A47C 1/032*** | (2006.01) |

(52) U.S. Cl. ..... 297/217.3; 297/325; 297/327; 297/330

(58) Field of Classification Search ..... 297/217.3, 297/330, 325, 327

See application file for complete search history.

(56) References Cited

U.S. PATENT DOCUMENTS

| | | | |
|---|---|---|---|
| 786,081 | A | 3/1905 | Witek |
| 2,983,790 | A | 5/1961 | Olson |
| 4,052,564 | A | 10/1977 | Propst et al. |
| 4,304,386 | A | 12/1981 | Nagashima et al. |
| 4,460,217 | A | 7/1984 | Tsuda et al. |
| 4,467,252 | A | 8/1984 | Takeda et al. |
| 4,470,632 | A | 9/1984 | Babbs |
| 4,655,505 | A | 4/1987 | Kashiwamura et al. |
| 4,933,618 | A | 6/1990 | Ortlieb |
| 4,944,554 | A | 7/1990 | Gross et al. |
| 5,015,035 | A | 5/1991 | Stoeckl et al. |
| 5,181,762 | A | 1/1993 | Beumer |
| 5,190,349 | A | 3/1993 | Austin, Jr. et al. |
| 5,211,172 | A | 5/1993 | McGuane et al. |
| 5,214,360 | A | 5/1993 | Gonser et al. |
| 5,266,070 | A | 11/1993 | Hagiwara et al. |

(Continued)

*Primary Examiner*—Rodney B. White
(74) *Attorney, Agent, or Firm*—Brinks Hofer Gilson & Lione; Gregory H. Zayia

(57) ABSTRACT

Office components are described that include an electrical conduit electrically coupled to a fuel cell, and an electrically powered device coupled to the electrical conduit and configured to receive electricity generated by the fuel cell. The electrically powered device includes at least one of an automatic adjustment mechanism, a control system, a sound masking system, and an office accessory. Chairs, methods of using chairs, and systems of chairs are also described.

18 Claims, 9 Drawing Sheets

U.S. PATENT DOCUMENTS

| | | | |
|---|---|---|---|
| 5,267,778 | A | 12/1993 | Krebs et al. |
| 5,342,114 | A | 8/1994 | Burke et al. |
| 5,467,002 | A | 11/1995 | Brooks |
| 5,484,188 | A | 1/1996 | Stoeckl |
| 5,556,163 | A | 9/1996 | Rogers, III et al. |
| 5,678,886 | A | 10/1997 | Infanti |
| 5,765,910 | A | 6/1998 | Larkin et al. |
| 5,803,545 | A | 9/1998 | Guguin |
| 5,803,547 | A | 9/1998 | Brown |
| 5,812,399 | A | 9/1998 | Judic et al. |
| 5,844,996 | A | 12/1998 | Enzmann et al. |
| 5,884,350 | A | 3/1999 | Kurze |
| 5,984,349 | A | 11/1999 | Van Voorhies |
| 5,992,931 | A | 11/1999 | LaPointe et al. |
| 6,033,021 | A | 3/2000 | Udo et al. |
| 6,056,079 | A | 5/2000 | Cech et al. |
| 6,068,280 | A | 5/2000 | Torres |
| 6,088,642 | A | 7/2000 | Finkelstein et al. |
| 6,188,771 | B1 | 2/2001 | Horrall |
| 6,289,538 | B1 | 9/2001 | Fidge |
| 6,425,635 | B1 | 7/2002 | Pulver |
| 6,659,562 | B2 | 12/2003 | Uchiyama |
| 6,731,088 | B2 | 5/2004 | Nivet |
| 6,752,463 | B2 | 6/2004 | Nivet |
| 6,874,855 | B2 | 4/2005 | Nivet |
| 6,964,370 | B1 | 11/2005 | Hagale et al. |
| 2002/0070591 | A1 | 6/2002 | Nivet |
| 2003/0025366 | A1 | 2/2003 | Barreiro, Jr. |
| 2004/0195876 | A1 | 10/2004 | Huiban |
| 2005/0121959 | A1 | 6/2005 | Kruse et al. |

OFFICE COMPONENTS, SEATING STRUCTURES, METHODS OF USING SEATING STRUCTURES, AND SYSTEMS OF SEATING STRUCTURES

RELATED APPLICATION

This application is a divisional of prior application Ser. No. 10/627,354, filed Jul. 24, 2003 now U.S. Pat. No. 7,163,263, which claims the benefit of priority under 35 U.S.C. § 119(e) to U.S. provisional patent application Ser. No. 60/398,514, filed Jul. 25, 2002, the entire contents of both of which are incorporated herein by reference.

FIELD OF THE INVENTION

The present invention relates generally to electrically powered office components and, more particularly, to electrically powered automatically adjustable office components. In a series of presently preferred embodiments, the present invention relates to electrically powered automatically adjustable chairs.

BACKGROUND

The ability to adjust the configuration of a piece of furniture to correspond to the unique physical stature and/or personal preferences of an individual provides a mechanism for increasing the comfort, physical well-being (e.g., posture, spinal health, etc.), and in the case of office furniture, on-the-job productivity and satisfaction of the individual. Office and task chairs of the type described in U.S. Pat. No. 5,556,163 to Rogers, III et al. can be operated to adjust various chair settings (e.g., tilt, depth, height). However, while the adjustment mechanisms are electrically powered, the user still retains full responsibility for activating the adjustment mechanisms and for regulating the degree of adjustments made. An automatic adjustment mechanism capable of both sensing and delivering a particular degree of adjustment desirable for and/or desired by an individual without requiring the individual's supervision would be clearly advantageous.

Adjustment mechanisms for adjustable furniture may be based on non-automated mechanical systems powered completely by a user (e.g., by using levers or knobs to adjust tilt, height, etc. of a chair), or on automated systems powered by cordless power sources. The latter type is greatly preferred from the standpoint of user convenience and satisfaction.

Typically, sources of cordless power suitable for indoor applications have been limited primarily to conventional batteries. However, inasmuch as the reactants in a battery are stored internally, the batteries must be replaced or recharged once their reactants have been depleted. An alternative power source that would not require replacement or recharging, which is suitable for use in indoor environments, and which does not require connection or access to electrical outlets or lighting (either direct or indirect) would be advantageously employed in combination with electrically powered office furniture.

SUMMARY

The scope of the present invention is defined solely by the appended claims, and is not affected to any degree by the statements within this summary.

Briefly stated, a first office component embodying features of the present invention includes an electrical conduit electrically coupled to a fuel cell, and an electrically powered device coupled to the electrical conduit and configured to receive electricity generated by the fuel cell.

A second office component embodying features of the present invention includes an electrical conduit electrically coupled to a fuel cell; and an electrically powered device coupled to the electrical conduit and configured to receive electricity generated by the fuel cell. The fuel cell is selected from the group consisting of a polymer electrolyte membrane fuel cell, a direct methanol fuel cell, an alkaline fuel cell, a phosphoric acid fuel cell, a molten carbonate fuel cell, a solid oxide fuel cell, and combinations thereof.

A third office component embodying features of the present invention includes a fuel cell; an electrical conduit electrically coupled to the fuel cell; and an electrically powered device coupled to the electrical conduit and configured to receive electricity generated by the fuel cell. The fuel cell is selected from the group consisting of a polymer electrolyte membrane fuel cell, a direct methanol fuel cell, an alkaline fuel cell, a phosphoric acid fuel cell, a molten carbonate fuel cell, a solid oxide fuel cell, and combinations thereof.

A fourth office component embodying features of the present invention includes an electrical conduit electrically coupled to a fuel cell; a power capacitor electrically coupled to the fuel cell; and an electrically powered device coupled to the electrical conduit and configured to receive electricity generated by the fuel cell.

A fifth office component embodying features of the present invention includes a fuel cell; an electrical conduit electrically coupled to the fuel cell; a power capacitor electrically coupled to the fuel cell; and an electrically powered device coupled to the electrical conduit and configured to receive electricity generated by the fuel cell.

A sixth office component embodying features of the present invention includes an electrical conduit electrically coupled to a fuel cell; an inverter coupled to the fuel cell; an electrical outlet coupled to the inverter; and an electrically powered device coupled to the electrical conduit and configured to receive electricity generated by the fuel cell.

A seventh office component embodying features of the present invention includes a fuel cell; an electrical conduit electrically coupled to the fuel cell; an inverter coupled to the fuel cell; an electrical outlet coupled to the inverter; and an electrically powered device coupled to the electrical conduit and configured to receive electricity generated by the fuel cell.

An eight office component embodying features of the present invention includes an electrical conduit electrically coupled to a fuel cell; a power capacitor electrically coupled to the fuel cell; an inverter coupled to the power capacitor; an electrical outlet coupled to the inverter; and an electrically powered device coupled to the electrical conduit and configured to receive electricity generated by the fuel cell.

A first seating structure embodying features of the present invention includes a base; a seat supported by the base; an electrical conduit electrically coupled to a power source; and an automatic height adjustment mechanism coupled to the electrical conduit and configured to receive electricity from the power source. The automatic height adjustment mechanism includes an actuator; a gear rotatably connected to the actuator, wherein the gear rotates a height-adjustable shaft connecting the seat to the base of the chair; a microprocessor electrically coupled to the actuator; and a load sensor electrically coupled to the microprocessor, wherein the load sensor provides a signal to the microprocessor indicative of whether the height of the chair should be increased, decreased, or held constant.

A second seating structure embodying features of the present invention includes a base; a seat supported by the base; an electrical conduit electrically coupled to a power source; and an automatic tilt adjustment mechanism coupled to the electrical conduit and configured to receive electricity from the power source. The automatic tilt adjustment mechanism includes an actuator; a biasing member mechanically coupled to the actuator, wherein the biasing member biases the seat; a microprocessor electrically coupled to the actuator; and a load sensor electrically coupled to the microprocessor. The load sensor detects a weight on the seat; the microprocessor calculates a target biasing force for the biasing member based on the weight detected by the load sensor; and the actuator adjusts the biasing member to achieve the target biasing force.

A third seating structure embodying features of the present invention includes a base; a seat supported by the base; an electrical conduit electrically coupled to a power source; and an automatic tilt adjustment mechanism coupled to the electrical conduit and configured to receive electricity from the power source. The automatic tilt adjustment mechanism includes an actuator; a biasing member mechanically coupled to the actuator, wherein the biasing member biases the seat; a microprocessor electrically coupled to the actuator; and a transducer electrically coupled to the microprocessor. The transducer detects an angle of inclination of the seat; and the actuator adjusts the biasing member to achieve a default position for the seat.

A fourth seating structure embodying features of the present invention includes a base and a seat supported by the base; an electrical conduit electrically coupled to a power source; and an automatic tilt adjustment mechanism coupled to the electrical conduit and configured to receive electricity from the power source. The automatic tilt adjustment mechanism includes a motor; a spring coupled to the motor, wherein the spring biases the seat; a microprocessor electrically coupled to the motor; and a transducer electrically coupled to the microprocessor. The transducer detects an angle of inclination of the seat; and the motor adjusts torque of the spring to achieve a default position for the seat.

A fifth seating structure embodying features of the present invention includes a base and a seat supported by the base; a microprocessor; an automatic tilt adjustment mechanism electrically coupled to the microprocessor; a digital display electrically coupled to the microprocessor; an encoded device reader electrically coupled to the microprocessor; and an encoded device writer electrically coupled to the microprocessor.

A sixth seating structure embodying features of the present invention includes a base and a seat supported by the base; a microprocessor; means for automatic tilt adjustment electrically coupled to the microprocessor; means for visual display electrically coupled to the microprocessor; means for reading stored data electrically coupled to the microprocessor; and means for storing data electrically coupled to the microprocessor.

A seventh seating structure embodying features of the present invention includes a base; a seat supported by the base; a backrest connected to the seat; and an adjustment mechanism. The seat and the backrest include a membrane; and the adjustment mechanism includes a motor; a torsion spring coupled to the motor, wherein the torsion spring biases at least one of the seat and the backrest; and a control system coupled to the motor, whereby the motor can be operated in at least one of a forward and a reverse direction, and whereby torque applied to the torsion spring can be adjusted.

A first method of using a seating structure embodying features of the present invention includes storing personalized seating structure settings on an encoded device; and reading the personalized seating structure settings using an electrically powered control system connected to the seating structure, wherein the electrically powered control system is configured to receive electricity generated by a fuel cell.

A second method of using a seating structure embodying features of the present invention includes storing personalized seating structure settings on an encoded device, wherein the personalized seating structure settings comprise a seating structure tilt setting; reading the personalized seating structure settings using an electrically powered control system connected to the seating structure; and automatically adjusting seating structure tilt.

A system of seating structures embodying features of the present invention includes a plurality of seating structures, wherein each component seating structure of the plurality includes a microprocessor electrically coupled to a fuel cell; an encoded device reader electrically coupled to the microprocessor; and an encoded device writer electrically coupled to the microprocessor.

DETAILED DESCRIPTION OF THE PRESENTLY PREFERRED EMBODIMENTS

Figure 1:
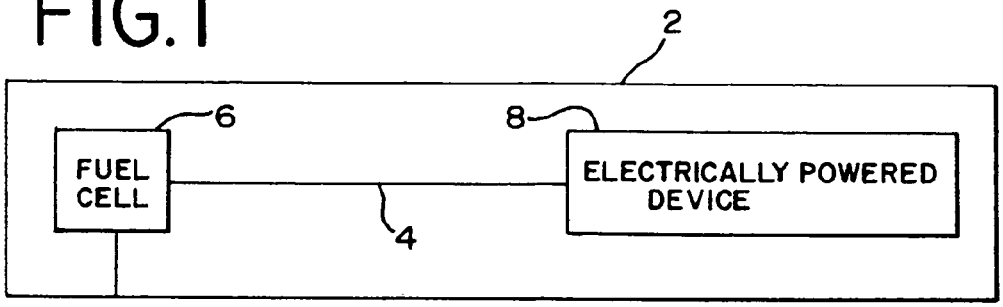
FIG. 1 shows a first office component embodying features of the present invention.

Office components with the capacity to automatically adjust one or more settings to conform to the unique physical stature and/or personal preferences of an individual user have been discovered and are described hereinbelow, including but not limited to chairs that have at least one of an automatic height adjustment mechanism and an automatic tilt adjustment mechanism.

In addition, it has been discovered that office components containing at least one electrically powered device, which may include one or both of the above-mentioned automatic adjustment mechanisms, can be powered by electricity generated from a fuel cell that is either attached to or remote from the office component. A fuel cell is an electrochemical device of increasing interest in the automotive industry as an environmentally benign potential replacement for the internal combustion engine. As is explained more fully hereinbelow, a fuel cell generates electricity from the electrochemical reaction between a fuel, such as hydrogen, and an oxidant, such as ambient oxygen. Water and heat are generally produced as byproducts of this electrochemical reaction.

Throughout this description and in the appended claims, the following definitions are to be understood:

The phrase "office component" refers to any type of portable or stationary furniture, particularly though not necessarily furniture used in an office. Representative office components include but are not limited to chairs, workstations (e.g., tables, desks, etc.), support columns and/or beams, wall panels, storage devices, bookcases, bookshelves, computer docking stations, computer internet portals, telephone switchboards, and the like, and combinations thereof, including for example and without limitation office furniture systems including and/or integrating one or more such components.

The phrase "seating structure" refers to any surface capable of supporting a person, including but not limited to chairs, benches, pews, stools, and the like. Seating structures may be portable (e.g., office chairs, barstools, etc.) or fixed to a surface (e.g., automobile seats, airplane seats, train seats, etc.).

The phrase "electrical conduit" refers to any complete or partial path over which an electrical current may flow.

The phrase "fuel cell" refers to any type of fuel cell, including but not limited to: polymer electrolyte membrane (PEM) fuel cells, direct methanol fuel cells, alkaline fuel cells, phosphoric acid fuel cells, molten carbonate fuel cells, solid oxide fuel cells, and any combination thereof. In addition, the phrase "fuel cell" should be understood as encompassing one or multiple individual fuel cells, and one or multiple individual "stacks" (i.e., electrically coupled combinations) of fuel cells.

The phrase "control system" refers to any computerized interface through which electronic functions may be regulated, data may be stored, or data may be read.

The phrase "office accessory" refers to any electronically powered device utilized in an office.

The phrase "power source" refers to any source of electrical power, including but not limited to fuel cells, batteries, solar cells, and the like, and combinations thereof.

The phrase "power capacitor" refers to any device capable of storing an electrical current, including but not limited to a battery.

The term "actuator" refers to any motive, electromotive, electrical, chemical, hydraulic, air, or electrochemical source of mechanical energy, including but not limited to motors, engines, and the like, and combinations thereof.

The phrase "load sensor" refers to any device capable of sensing the presence of and/or weighing an object or entity placed on a supporting surface. Suitable load sensors for use in accordance with the present invention include but are not limited to strain gages (i.e., mechanical devices that measure strain by measuring changes in length), spring gages, piezo devices (i.e., devices that convert mechanical energy into electrical energy), force sensitive resistors or FSRs (i.e., devices that work with resistive ink to measure load changes), springs and potentiometers, and the like, and combinations thereof.

The phrase "biasing member" refers to any device that can be moved and/or reversibly deformed, such that the movement and/or deformation provides a biasing force against a member mechanically coupled thereto. Representative biasing members include but are not limited to torsion springs (e.g., elastomeric torsion springs, coil springs, etc.), leaf springs, tension springs, compression springs, spiral springs, volute springs, flat springs, pneumatic devices, hydraulic devices, and the like, and combinations thereof.

The phrase "actuating member" refers to any device that can move and/or reversibly deform a biasing member. Representative actuating members include but are not limited to torque levers, fulcrum members, screws, and the like, and combinations thereof.

The term "transducer" refers to any device capable of sensing the position, angle of inclination, torque, or tension of a biasing member, actuating member, or any member mechanically coupled thereto, and of signaling a microprocessor when a target position, angle of inclination, torque or tension has been achieved. Representative transducers include but are not limited to translational position transducers (i.e., which determine position along one linear axis) and rotational position transducers (i.e., which determine position by measuring angular location of an element).

The phrase "encoded device" refers to any portable device capable of storing information. Representative encoded devices include but are not limited to cards, badges, keys, and the like, and combinations thereof.

The phrase "encoded device reader" refers to any device capable of decoding information stored on an encoded device, and of translating a signal to a processor.

The phrase "encoded device writer" refers to any device capable of saving information onto an encoded device.

The phrase "memory device" refers to any hardware device capable of storing information.

The phrase "control member" refers to any device capable of activating or deactivating a fuel cell, and of enabling a fuel cell to operate in either a "cycling" or "steady state" mode. In a "cycling" mode, the control member activates the fuel cell for a period of time when the power level of a power capacitor reaches a minimum set point, and deactivates the fuel cell when a power level of the power capacitor reaches a maximum set point.

Figure 2:
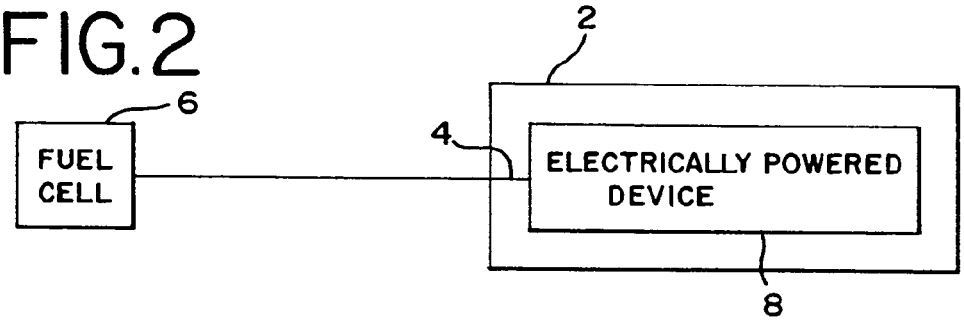
FIG. 2 shows a second office component embodying features of the present invention.

An office component 2 embodying features of the present invention is shown in FIGS. 1 and 2. The office component 2 includes an electrical conduit 4 electrically coupled to a fuel cell 6, and an electrically powered device 8 coupled to the electrical conduit 4 and configured to receive electricity generated by the fuel cell 6. The fuel cell 6 may either be attached to the office component 2, as shown in FIG. 1, or else remote thereto, as shown in FIG. 2, with attachment being especially preferred.

Figure 3:
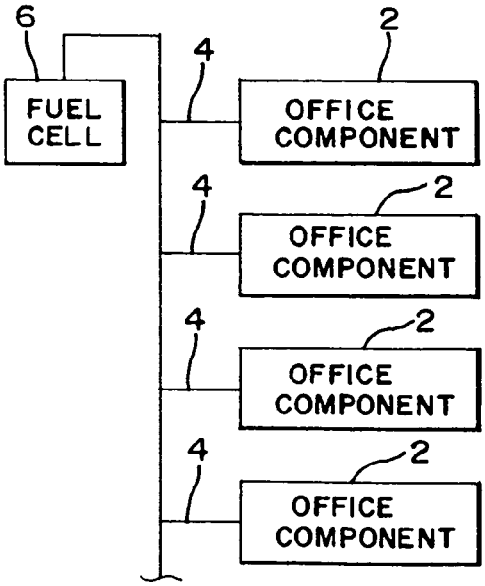
FIG. 3 shows a remote fuel cell powering a plurality of office components in accordance with the present invention.

In a first series of presently preferred embodiments, shown in FIG. 3, one remote fuel cell 6 is electrically coupled to a plurality of electrical conduits 4, and is configured to provide electricity to a plurality of office components 2. The electrical conduits 4 can be electrically coupled to the remote fuel cell 6 by any of the methods known in the art, including but not limited to via wires, cables, or the like. It is preferred in such instances that the wires or cables be removed from view and from potential pedestrian traffic, for example, through concealment under carpeting, walls, wainscoting, conduits, wire management devices, or the like.

Figure 4:
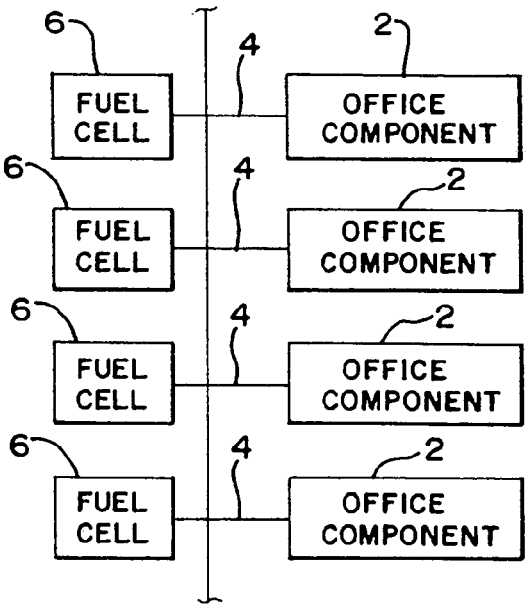
FIG. 4 shows a plurality of fuel cells powering a plurality of office components in accordance with the present invention.

In a second series of presently preferred embodiments, shown in FIG. 4, a plurality of remote fuel cells 6, configured to provide electricity to a plurality of office components 2, are electrically coupled to a plurality of electrical conduits 4 in a grid-like configuration. The electrical conduits 4 can be electrically coupled to the remote fuel cell 6 by any of the methods known in the art, as described above.

The type of electrically powered device used in accordance with the present invention is unrestricted. Presently preferred devices included but are not limited to automatic adjustment mechanisms, control systems, sound masking systems, office accessories, and the like, and combinations thereof. For office components including at least one automatic adjustment mechanism, it is preferred that the office component also includes at least one complementary manual override mechanism whereby the corresponding automatic adjustment mechanism can be deactivated.

A presently preferred office component for use in accordance with the present invention is a seating structure, with a presently preferred seating structure being a chair containing a seat supported by a base. Preferably, chairs embodying features of the present invention further contain a backrest, which is connected either directly or indirectly to the seat and/or to the base. In addition, it is preferred that chairs embodying features of the present invention include at least one automatic adjustment mechanism. It is especially preferred that the automatic adjustment mechanism adjust at least one of chair height and chair tilt (e.g., seat and/or backrest inclination), although the automatic adjustment mechanism can be configured to adjust other aspects, including but not limited to seat depth, armrest height, lumbar pressure, lumbar position, sacral support, spinal support, cranial support, thoracic support, foot support, leg support, calf support, etc. Preferably, chairs embodying features of the present invention may be adjusted—automatically or manually—to achieve a full range of postures from a seated to a reclined to a standing position.

It is preferred that the power source used in accordance with the present invention is a fuel cell, although alternative power sources including but not limited to batteries and solar cells have also been contemplated. The power source can either be attached to or remote from the office component. However, particularly for seating structures embodying features of the present invention, it is preferred that the power source be attached to the office component such that the office component will be portable (i.e., not fixedly mounted on or hardwired to either a floor or a remote power source).

Figure 6:
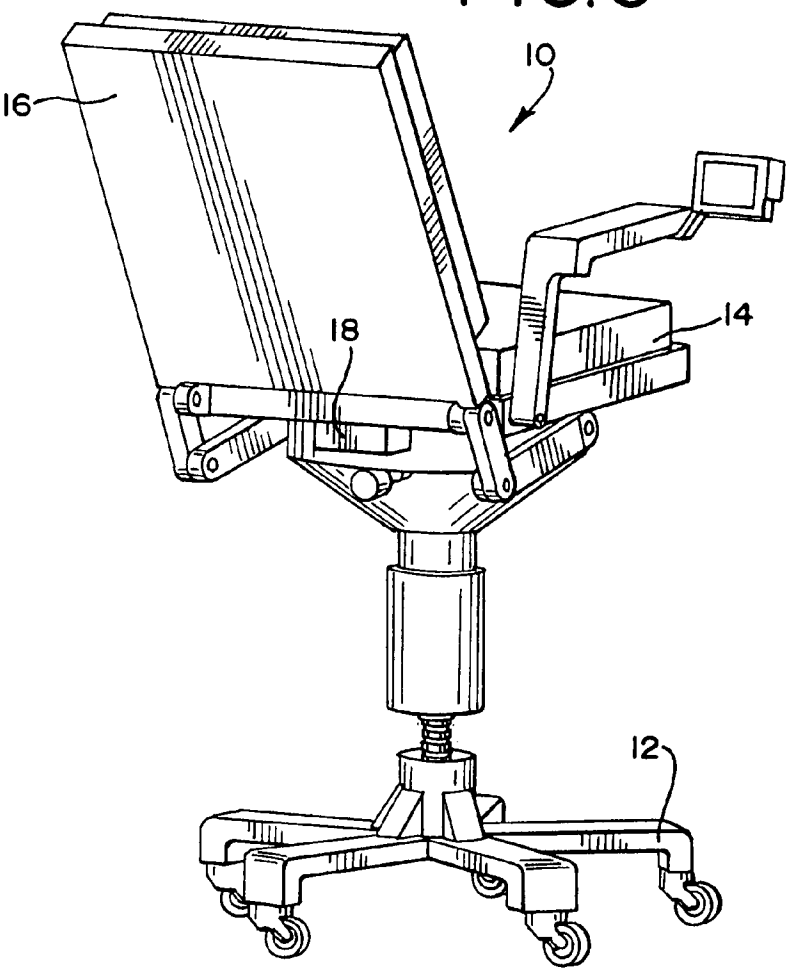
FIG. 6 shows a perspective rear view of the chair shown in FIG. 5.
Figure 5:
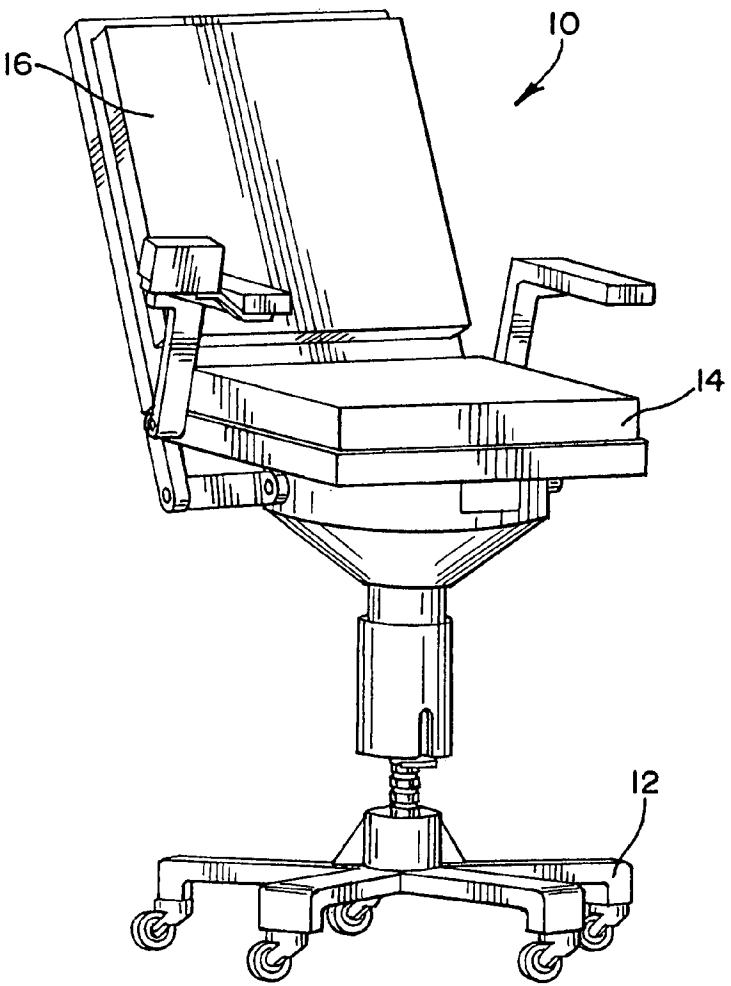
FIG. 5 shows a perspective front view of a chair embodying features of the present invention.

A chair 10 embodying features of the present invention is shown in FIGS. 5-6 and includes a base 12, a seat 14 connected to the base 12, a backrest 16 connected to the seat 14, and an electrical conduit (not shown) electrically coupled to a power source 18. It is preferred that at least one of the connection between seat 14 and base 12 and the connection between backrest 16 and seat 14 be an adjustable connection. In alternative configurations, backrest 16 is connected to base 12 instead of to seat 14.

Figure 8:
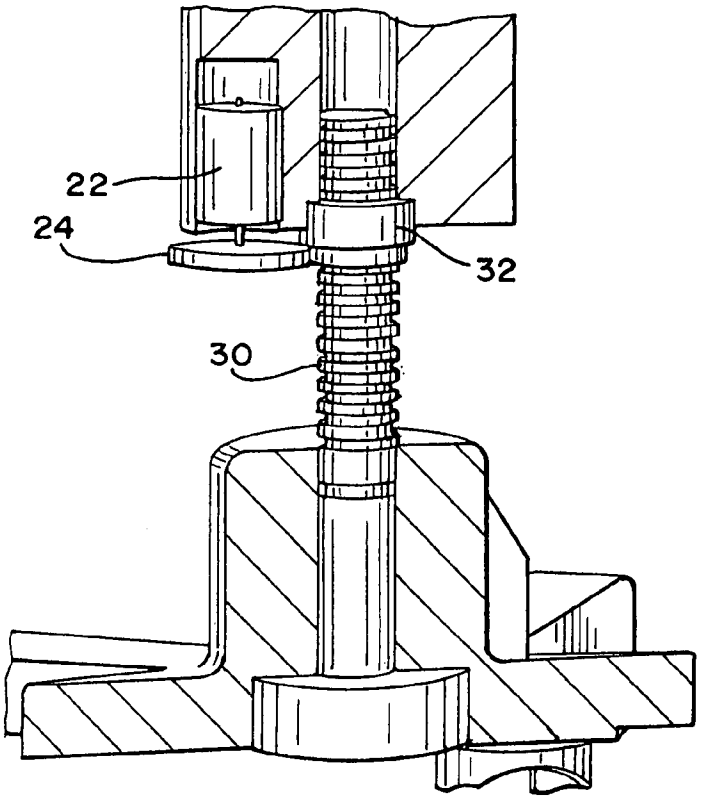
FIG. 8 shows a detailed view of the automatic height adjustment mechanism shown in FIG. 7.
Figure 7:
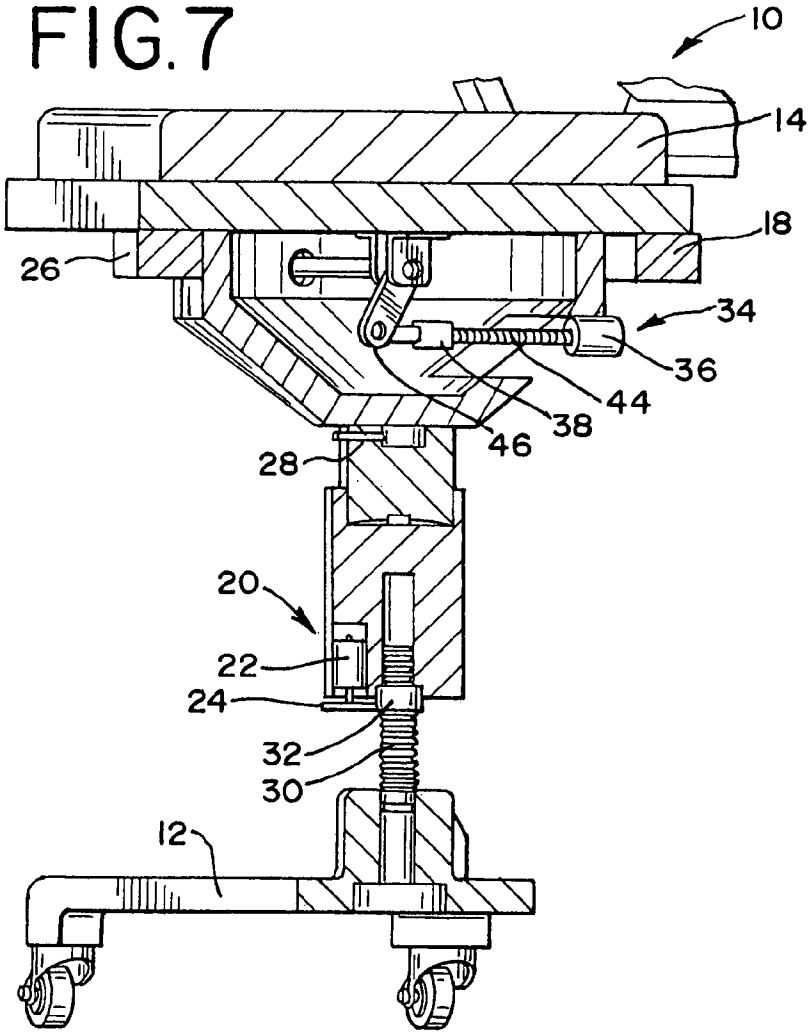
FIG. 7 shows a perspective view of an automatic height adjustment mechanism and an automatic tilt adjustment mechanism embodying features of the present invention.

In a first series of presently preferred embodiments, shown in FIGS. 7-8, the chair 10 includes an automatic height adjustment mechanism 20 coupled to the electrical conduit (not shown) and configured to receive electricity from the power source 18. The automatic height adjustment mechanism 20 includes an actuator 22 (e.g., a motor), a gear 24 rotatably connected to the actuator 22, a microprocessor 26 electrically coupled to the actuator 22, and a load sensor 28 electrically coupled to the microprocessor 26.

The gear 24 rotates a height-adjustable shaft 30 connecting seat 14 to base 12. Preferably, the automatic height adjustment mechanism 20 further includes a rotatably adjustable nut 32 on shaft 30, such that the gear 24 meshes with and rotates the rotatably adjustable nut 32. The rotatably adjustable nut 32 may include a ball bearing (not shown) whereby the nut rotates on a threaded portion of shaft 30.

The load sensor 28 provides a signal to the microprocessor 26 indicative of whether the height of the chair should be increased, decreased, or held constant. For example, the load sensor 28 can be used to detect whether and/or to what degree a load on the seat (e.g., a user) has been alleviated (e.g., when the user's feet become supported by the floor). Upon detecting that a load on the seat has been reduced or minimized, the automatic height adjustments would cease and the height of the chair would be held constant. Thus, upon sitting in a chair 10, a user would be detected by load sensor 28 and the height of chair 10 would be adjusted automatically until the load of the user detected by load sensor 28 reached a minimum.

Figure 9:
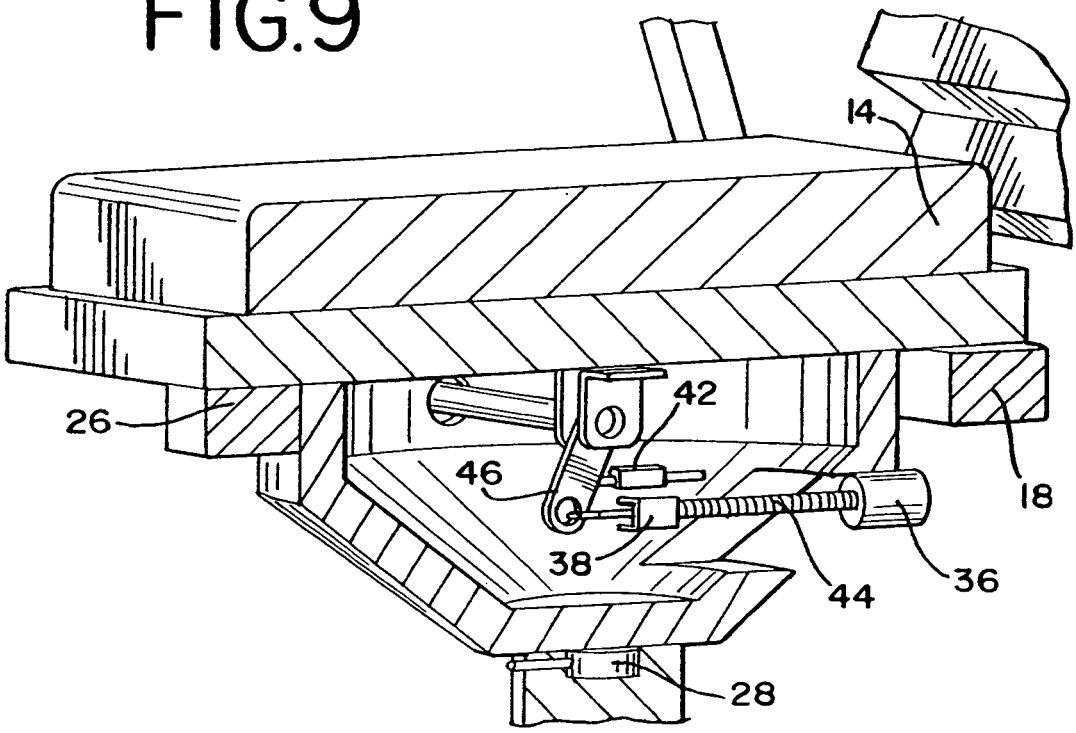
FIG. 9 shows a detailed view of the automatic tilt adjustment mechanism shown in FIG. 7.

In a second series of presently preferred embodiments, shown in FIGS. 7 and 9, the chair 10 includes an automatic tilt adjustment mechanism 34 coupled to the electrical conduit (not shown) and configured to receive electricity from the power source 18. The automatic tilt adjustment mechanism 34 includes an actuator 36, a biasing member 38 mechanically coupled to the actuator 36, a microprocessor 26 electrically coupled to the actuator 36, and a load sensor 28 electrically coupled to the microprocessor 26. Preferably, the biasing member 38 biases at least one of the seat 14 and the backrest 16.

The load sensor 28 detects a weight on the seat 14, and provides a signal to the microprocessor 26, as described above. The microprocessor 26 calculates a target biasing force for the biasing member 38 based on the weight detected by load sensor 28 (e.g., by using a built-in algorithm relating proper spring tension to a person's weight), and the actuator 36 adjusts biasing member 38 to achieve the target biasing force. Thus, automatic tilt adjustment mechanism 34 provides automatic back support for an individual according to the individual's weight, with a heavier person requiring more tilt support than a lighter person.

Alternatively, upon receiving information from load sensor 28 relating to the weight of a user occupying chair 10, microprocessor 26 may calculate an appropriate position, tension, or torque of an actuating member 44 acting on biasing member 38, and instruct actuator 36 to adjust actuating member 44 accordingly.

Although it is contemplated that separate microprocessors can be employed for chair embodiments that include both an automatic height adjustment mechanism 20 and an automatic tilt adjustment mechanism 34, it is preferred that a common microprocessor (e.g., 26) be employed as the controller for both mechanisms, as shown in FIG. 7. Similarly, for chair embodiments including both an automatic height adjustment mechanism 20 and an automatic tilt adjustment mechanism 34, it is preferred that a common load sensor (e.g., 28) be employed for both mechanisms, as shown in FIG. 7.

Preferred biasing members for use in accordance with automatic tilt adjustment mechanisms embodying features of the present invention include but are not limited to springs, pneumatic devices, and hydraulic devices, with springs being especially preferred. Representative springs for use in accordance with the present invention include torsion springs (e.g., elastomeric torsion springs, coil springs, etc.), leaf springs, tension springs, compression springs, spiral springs, volute springs, and flat springs. Torsion springs of a type described in U.S. Pat. Nos. 5,765,914 to Britain et al. and U.S. Pat. No. 5,772,282 to Stumpf et al., and leaf springs of a type described in U.S. Pat. No. 6,250,715 to Caruso et al. are particularly preferred for use in accordance with the present invention. The contents of all three patents are incorporated herein by reference in their entirety, except that in the event of any inconsistent disclosure or definition from the present application, the disclosure or definition herein shall be deemed to prevail.

Preferred actuating members for use in accordance with torsion spring biasing members include torque levers, while preferred actuating members for use in accordance with leaf spring biasing members include fulcrum members.

Preferably, automatic tilt adjustment mechanisms embodying features of the present invention further include a transducer 42, as shown in FIG. 9. The transducer 42 (e.g., a rotational or translational position transducer) senses when biasing member 38, actuating member 44, or any member mechanically coupled thereto (e.g., seat 14, backrest 16, etc.) has achieved a desired position, torque, or tension and then communicates the information to microprocessor 26, which then disengages actuator 36. For example, when biasing member 38 is a leaf spring and actuating member 44 is a fulcrum member, transducer 42 can be tied to the position of the fulcrum. Alternatively, when biasing member 38 is a torsion spring and actuating member 44 is a torque lever, transducer 42 can be tied to the torque lever used to torque the torsion spring.

As shown in FIGS. 7 and 9, biasing member 38 (e.g., a tilt adjustment spring) is mechanically coupled to actuator 36 by the intermediacy of a screw 44, and spring 38 is coupled to a tilt link 46. Thus, moving (i.e., stretching or releasing) spring 38 acts to increase or decrease the load on tilt link 46, which in turn acts to increase or decrease the amount of back support provided to an individual by backrest 16. The actuator 36 (e.g., a motor) continues to move spring 38 by the agency of screw 44 until such time as the position transducer 42 informs microprocessor 26 that spring 38 has achieved the target position and/or target tension and is thus providing the requisite degree of support.

In a third series of presently preferred embodiments, a desired default position for the seat 14 and/or backrest 16 of the chair 10—unrelated to the weight and other physical characteristics of a potential user—may be determined a priori and programmed into the microprocessor 26. In such embodiments, the transducer 42 would detect the angle of inclination of seat 14 and/or backrest 16. Upon detecting a previous user rising from the chair or upon detecting a new user first occupying the chair (e.g., through the use of a load sensor, solenoid valve, or the like), microprocessor 26 will engage actuator 36, which acts to restore seat 14 and/or backrest 16 to a default position until such time as the transducer 42 informs microprocessor 26 that a default angle of inclination has been achieved.

Figure 10:
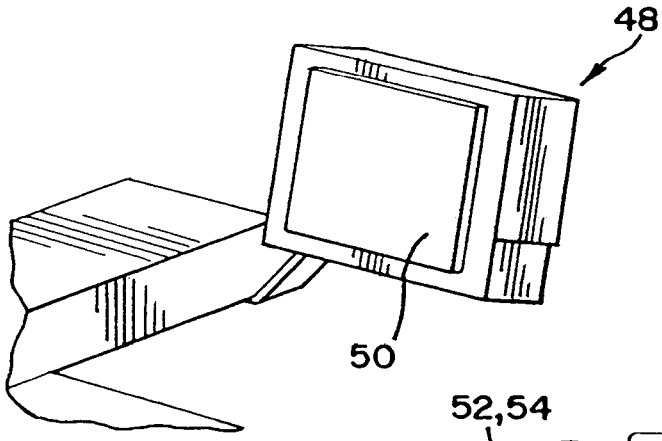
FIG. 10 shows a front view of a digital display and card reader embodying features of the present invention.
Figure 11:
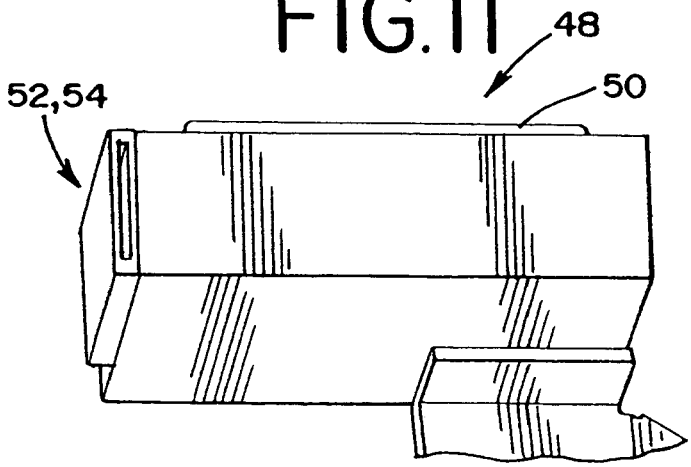
FIG. 11 shows a top view of the digital display and card reader shown in FIG. 10.

In a fourth series of presently preferred embodiments, the chair 10 includes a microprocessor 26 electrically coupled to a power source 18, a memory device electrically coupled to the microprocessor 26, and a control system 48 electrically coupled to the microprocessor 26, shown in detail in FIGS. 10 and 11. The control system 48 preferably includes a digital display 50 and a user interface whereby a user can monitor and adjust chair settings (e.g., chair tilt, chair height, seat depth, armrest height, lumbar pressure, lumbar position, sacral support, spinal support, cranial support, thoracic support, foot support, leg support, calf support, etc.), activate a manual override mechanism to prevent automatic adjustments from being made, store new settings onto an encoded device, read saved settings from an encoded device, or the like. Preferably, the digital display 50 is touch sensitive, although it is also contemplated that control system 48 can include a keypad, keyboard, voice recognition system, tactile-activated switches and sensors (e.g., mechanisms that are activated according to the movements of a user in the chair), or the like, to allow for alternative methods of information entry.

The digital display 50 is electrically coupled to microprocessor 26, which serves as a logic controller. Thus, commands entered by a user through one or more of the user interfaces described above will be conveyed to microprocessor 26 and executed. The touch-sensitive digital display 50 preferably provides selectable graphical images corresponding to each of the seating functions, adjustable parameters, and any other electronically controlled functions of the chair (e.g., tilt adjustment, height adjustment, manual override activation, etc.). In addition, the digital display 50 preferably enables manual fine-tuning of any automatically made adjustment.

In preferred embodiments, control system 48 further includes an encoded device reader 52, which is capable of reading an individual's personalized setting information from an encoded device, such as a card. Preferably, the control system 48 further includes an encoded device writer 54, which is capable of storing sets of preferred settings, and preferably multiple sets of preferred settings, onto an encoded device, such as a card, once they have been finalized by a user.

Thus, a user can quickly load personalized setting information stored on the card to any chair 10, with the chair 10 then automatically adjusting to conform to the personalized setting information supplied by the card.

In such a manner, a system of chairs may be developed that includes a plurality of chairs 10, each of which includes a microprocessor 26 coupled to a power source 18 (e.g., a fuel cell), an encoded device reader 52 electrically coupled to microprocessor 26, and an encoded device writer 54 electrically coupled to microprocessor 26. Thus, an individual present at a facility containing such a system of chairs will be able to quickly transform any of the chairs to conform to a set of preferred settings simply by inserting an encoded device on which the settings are stored into a card reader on any one of the chairs in the system.

Figure 12:
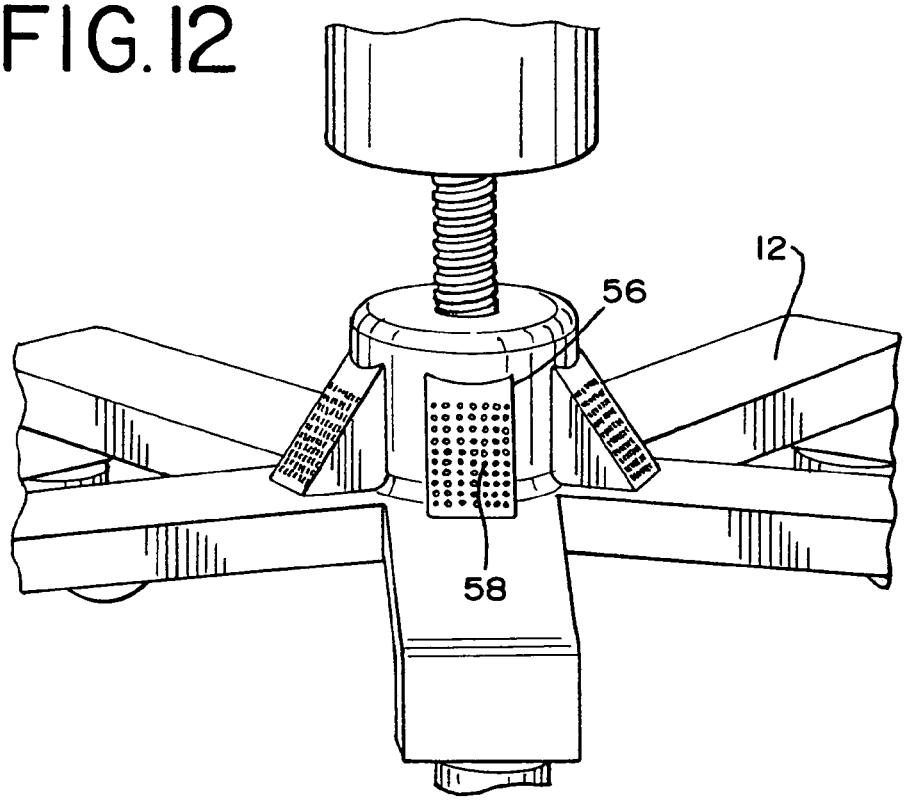
FIG. 12 shows a sound masking system embodying features of the present invention.

In a fifth series of presently preferred embodiments, shown in detail in FIG. 12, the chair 10 includes a sound masking system 56 mounted thereto, which is electrically coupled to the power source 18 and to the microprocessor 26. The sound masking system 56 includes one or more speakers 58, which can provide a masking sound (e.g., white noise) that moves with a user, and which is not limited geographically to the particular workspace in which the user is located. The sound masking system 56 is controlled by the microprocessor 26, and can be activated, deactivated, or adjusted through one or more of the user interfaces described above and/or encoded device reader 52, or separately by way of a switch, button, or other control. It is noted that although FIG. 12 shows sound masking system 56 located near the base 12 of chair 10, it may be preferable, in certain embodiments, to position it elsewhere on the chair 10, such as near the top of backrest 16 in proximity to the head of a user occupying the chair 10.

Preferred fuel cells for use in accordance with the present invention include but are not limited to the types described hereinabove. For a comparison of several fuel cell technologies, see Los Alamos National Laboratory monograph LA-UR-99-3231 entitled *Fuel Cells: Green Power* by Sharon Thomas and Marcia Zalbowitz, the entire contents of which are incorporated herein by reference, except that in the event of any inconsistent disclosure or definition from the present application, the disclosure or definition herein shall be deemed to prevail.

Figure 13:
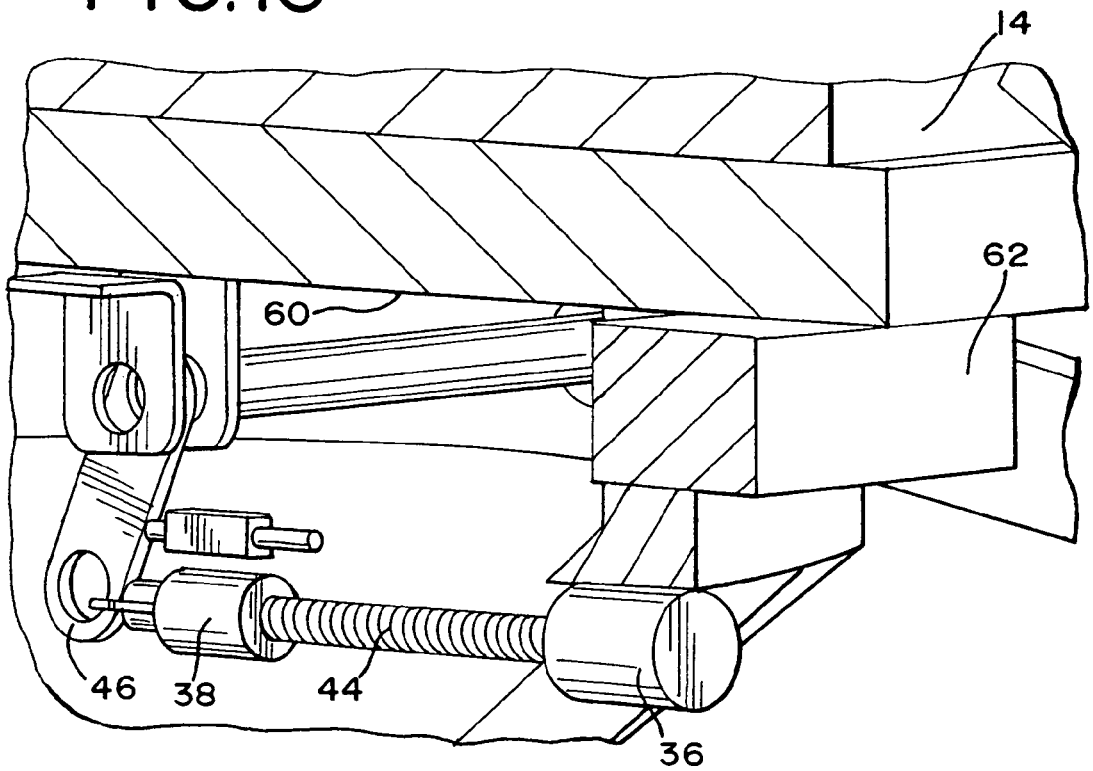
FIG. 13 shows a detailed view of an on-board power supply embodying features of the present invention.

Polymer electrolyte membrane (PEM) fuel cells and direct methanol fuel cells are especially preferred for use in accordance with the present invention, with PEM fuel cells being most preferred at present. As shown in FIG. 13, a fuel cell 62 may be attached to the chair 10 on an undersurface 60 of seat 14. It is to be understood that the location of attachment of a fuel cell to an office component embodying features of the present invention is unrestricted, but is preferably such that the fuel cell is concealed from view (e.g., for aesthetics) and does not interfere with an individual's utilization of the office component. In addition, as described above, it is preferred that the fuel cell be attached to the office component rather than remote thereto in order to render the office component portable and self-sufficient vis-à-vis its power consumption.

Figure 14:
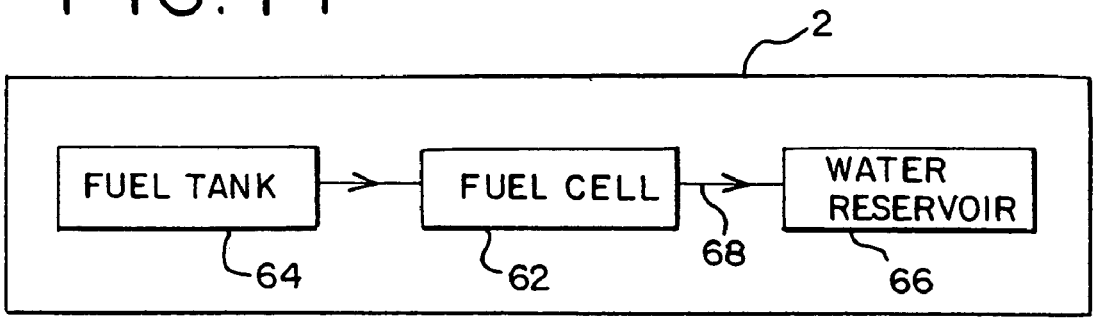
FIG. 14 shows a schematic illustration of a first fuel cell-containing office component embodying features of the present invention.

FIG. 14 shows an office component 2 embodying features of the present invention that includes a fuel cell 62, a fuel tank 64 connected to the fuel cell 62, and a water reservoir 66 connected to a water outlet 68 of the fuel cell 62 and configured to receive water generated by the fuel cell 62. For embodiments in which fuel cell 62 is a PEM fuel cell, fuel tank 64 may correspond to a cylinder containing hydrogen gas.

Figure 15:
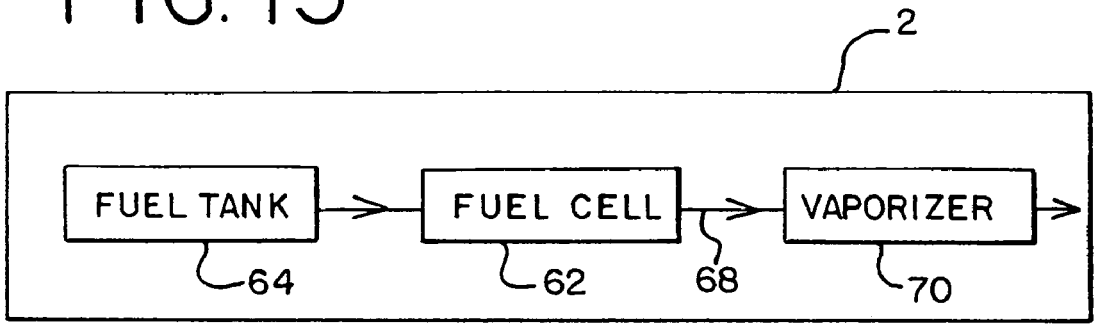
FIG. 15 shows a schematic illustration of a second fuel cell-containing office component embodying features of the present invention.

Preferably, the water reservoir 66 is readily detachable from the water outlet 68 to enable a user to periodically empty water collected therein. Alternatively, water reservoir 66 may preferably contain a desiccating material (e.g., sodium sulfate, silica gel, magnesium sulfate, etc.) that will react with and consume the water when it is generated. In a preferred embodiment, shown in FIG. 15, water generated by the fuel cell 62 is converted to humidity via passage through a vaporizer 70 connected to the water outlet 68 of fuel cell 62.

Figure 16:
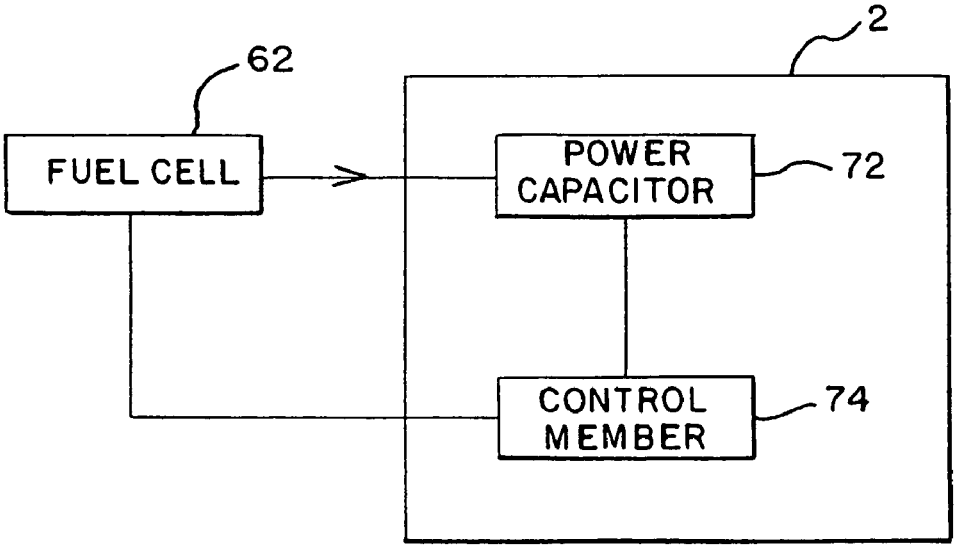
FIG. 16 shows a schematic illustration of a third fuel cell-containing office component embodying features of the present invention.

In a sixth series of presently preferred embodiments, shown in FIG. 16, an office component 2 includes a power capacitor 72 electrically coupled to a fuel cell 62 remote to the office component 2. A control member 74 is electrically coupled to the power capacitor 72 and to the remote fuel cell 62. In this series of embodiments, power capacitor 72, which may be a conventional storage battery, is used to power all of the electrically powered devices included in the office component until such time as a minimum power level set point of the power capacitor 72 is reached (e.g., the battery power is depleted or is nearing depletion). The control member 74 detects the minimum power level set point and activates the fuel cell 62 to recharge power capacitor 72. When a maximum power level set point of the power capacitor 72 is reached (i.e., the battery is fully recharged), the control member 74 deactivates the fuel cell.

Alternatively, if an electrical coupling between remote fuel cell 62 and power capacitor 72 is undesirable or inconvenient (e.g., a connection via wires or cables is impractical), the control member 74 may be equipped to provide a visual (e.g., blinking LED light) or audio (e.g., beeping) signal indicating that the power capacitor 72 requires (or soon will require) recharging, such that a temporary electrical connection between the fuel cell 62 and the power capacitor 72 can be established.

Figure 22:
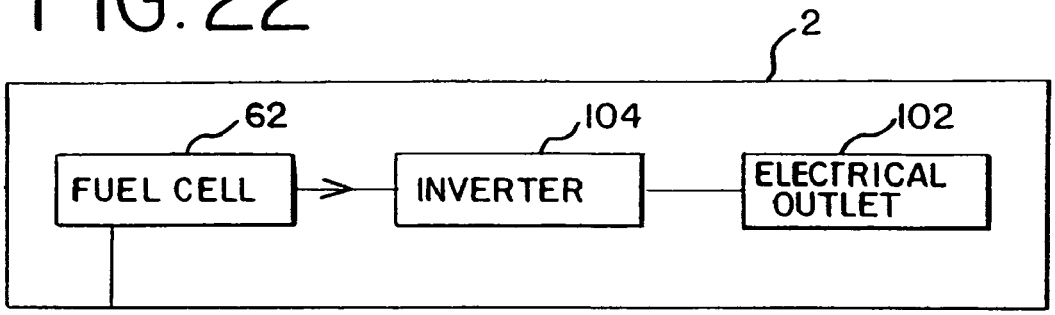
FIG. 22 shows a schematic illustration of a fourth fuel cell-containing office component embodying features of the present invention.
Figure 23:
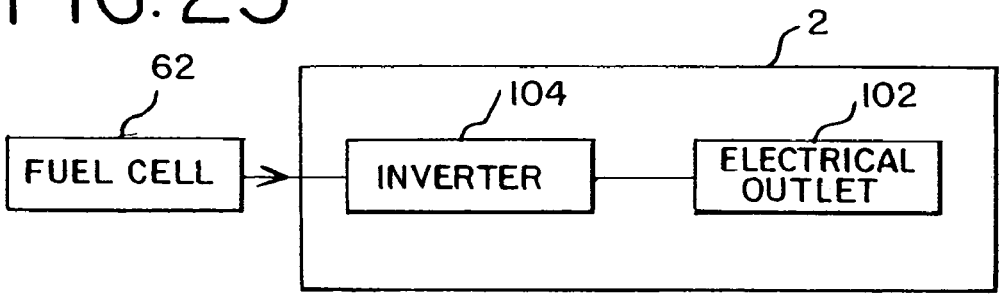
FIG. 23 shows a schematic illustration of a fifth fuel cell-containing office component embodying features of the present invention.
Figure 24:
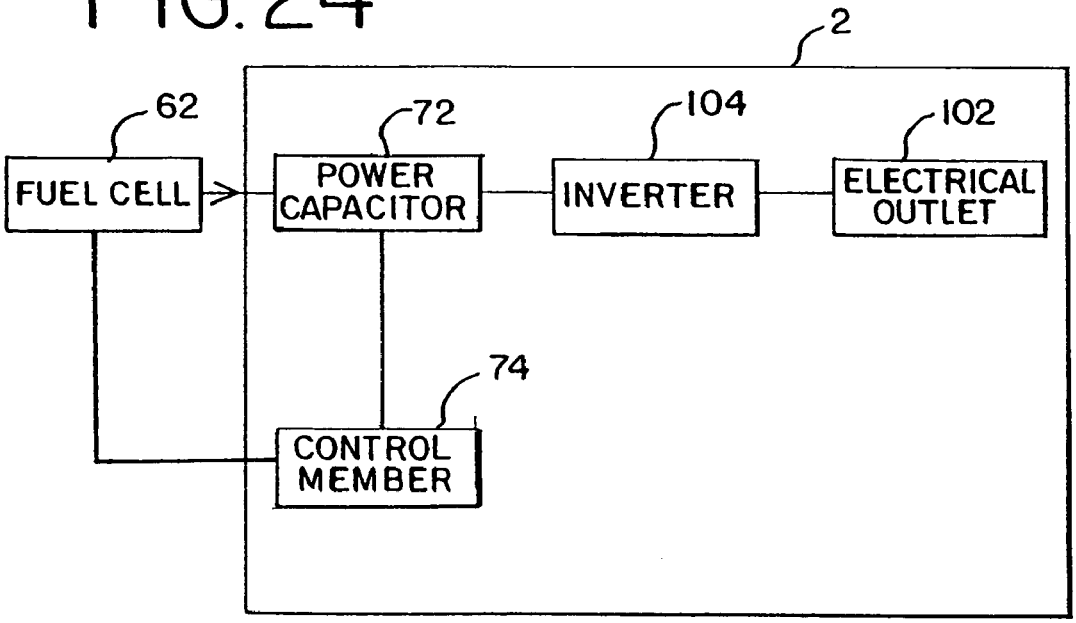
FIG. 24 shows a schematic illustration of a sixth fuel cell-containing office component embodying features of the present invention.

In a seventh series of presently preferred embodiments, shown in FIGS. 22-24, an office component 2 includes an electrical outlet 102, which is coupled to an inverter 104 (e.g., a DC to AC power inverter), which in turn is coupled to at least one of a fuel cell 62 and a power capacitor 72. In this series of embodiments, DC current drawn either directly from a fuel cell 62 or from a power capacitor 72 (which is itself supplied with electricity by a fuel cell 62) may be converted to conventional AC electricity. This AC electricity may then be used to power any device that utilizes AC current. Representative devices include but are not limited to laptop computers and their chargers, cellular phones and their chargers, personal digital assistants (PDAs) and their chargers, and the like. All manner of inverters are contemplated for use in accordance with the present invention, including but not limited to modified sine power inverters, pure sine power inverters, 12-volt power inverters, 24-volt power inverters, and the like.

For embodiments in which the inverter 104 is coupled to a fuel cell 62, the fuel cell 62 may either be attached to the office component 2, as shown in FIG. 22, or remote to the office component 2, as shown in FIG. 23. It is presently preferred that the fuel cell be attached to the office component rather than remote thereto such that that the office component is portable. Alternatively, as shown in FIG. 24 the inverter 104 may be coupled to a power capacitor 72 that is electrically coupled to a fuel cell 62 remote to the office component 2. As described above in connection with the sixth series of presently preferred embodiments, a control member 74 is preferably included in this arrangement in order to regulate the power level of power capacitor 72.

Thus, the user of an office component (e.g., a chair) equipped in accordance with the seventh series of presently preferred embodiments shown in FIGS. 22-24 would be able to utilize and/or charge the power supply of an electronic device (e.g., a laptop computer) without having to first locate a remote electrical outlet, such as a wall outlet, which might not be available in all environments. The incorporation of a self-sufficient electrical outlet directly into the office component is particularly advantageous in connection with portable office components embodying features of the present invention.

In the first series of presently preferred embodiments described above, the automatic height adjustment mechanism 20 includes a gear 24 rotatably connected to the actuator 22, wherein the gear 24 rotates a height-adjustable shaft 30 connecting the seat 14 to the base 12 (e.g., FIGS. 7-8). However, alternative means for automatic height adjustment can be used instead, and lie within the scope of this invention. Examples include but are not limited to alternative mechanical mechanisms (e.g., a collapsible/expandable jack-like support base), as well as pneumatic and/or hydraulic methods.

In the second and third series of presently preferred embodiments described above, the automatic tilt adjustment mechanism 34 includes a biasing member 38 (e.g., a spring) that exerts a biasing force on at least one of the seat 14 and the backrest 16 (e.g., FIGS. 7 and 9). However, alternative means for automatic tilt adjustment can be used instead, and lie within the scope of this invention. Examples include but are not limited to a height-adjustable support shaft connecting the base 12 to the rear surface of backrest 16, which when raised or lowered will decrease or increase, respectively, the angle of inclination of backrest 16.

In the fourth series of presently preferred embodiments described above, the digital display 50 is shown as a screen attached to an arm of the chair 10 (e.g., FIGS. 5, 6, 10, and 11). However, alternative means for visual display can be used instead, and lie within the scope of this invention. Examples include but are not limited to digital or mechanical tickers integrated into the structure of the chair (e.g., in an armrest), LED displays, and the like. Similarly, although the encoded device reader 52 and the encoded device writer 54 are shown as a slot into which a card is inserted (e.g., FIGS. 10-11), alternative means for reading stored information and alternative means for storing information can be used instead, and lie within the scope of this invention (e.g., wireless chip-containing rings, pens, etc.). Examples include but are not limited to encoding/decoding information using Magnetic Ink Character Recognition (MICR), Optical Character Recognition (OCR), bar codes, spot codes (e.g., fluorescent ink), perforations or notch systems, and magnetic wire Weigand-type systems.

In the fifth series of presently preferred embodiments described above, the sound masking system 56 is described as having one or more speakers 58, through which a masking sound (e.g., white noise) is delivered (e.g., FIG. 12). However, alternative means for sound masking can be used instead, and lie within the scope of this invention. Examples include but are not limited to generators that create an electrical signal having a similar or identical frequency to that of a sound to be masked, but which is opposite in amplitude and sign.

It is emphasized that while specific electrically powered devices have been described for use in accordance with the present invention (e.g., automatic adjustment mechanisms, control systems, sound masking systems, etc.) it is contemplated that any type of electrically powered device or office accessory may integrated into an office component embodying features of the present invention. It is preferred that the power requirements of the electrically powered device will match the power output of the power supply used therewith.

Representative office accessories that are suitable for integration into an office component embodying features of the present invention include but are not limited to climate control systems (e.g., fans, humidifiers, dehumidifiers, heaters, etc.), cooling devices, virtual goggles, lighting systems, computers, telecommunication systems (e.g., telephones, cellular phones, video and/or internet conferencing, web cam integration, infrared transceivers, etc.), relaxation stimulation systems (e.g., back and/or body massagers, acoustic stimuli, aromatizers, etc.), biofeedback systems (e.g., electrocardiograms, pulse and/or respiration monitors, etc.), computer (laptop) docking stations with wireless LAN connections, wireless keyboards, wireless mice, computer flat screen integration, pencil sharpeners, staplers, Dictaphones, cassette recorders, PDAs, and the like, and combinations thereof.

A preferred design for a chair embodying features of the present invention incorporates one or more features of the ergonomic office chairs sold under the tradename AERON® by Herman Miller (Zeeland, Mich.). Features of AERON® chairs that may be desirably incorporated into chairs embodying features of the present invention include but are not limited to: seats and backrests comprised of a form-fitting, breathable woven mesh membrane; one-piece carrier members for securing the periphery of the woven mesh membranes to the chair frames; mechanisms for controlling tilt range and resistance to tilting; and linkage assemblies by which seats and backrests may pivot about hip pivot points while simultaneously tilting rearwardly. Additional descriptions of these and other features may be found in the Stumpf et al. patent incorporated by reference hereinabove.

Figure 18:
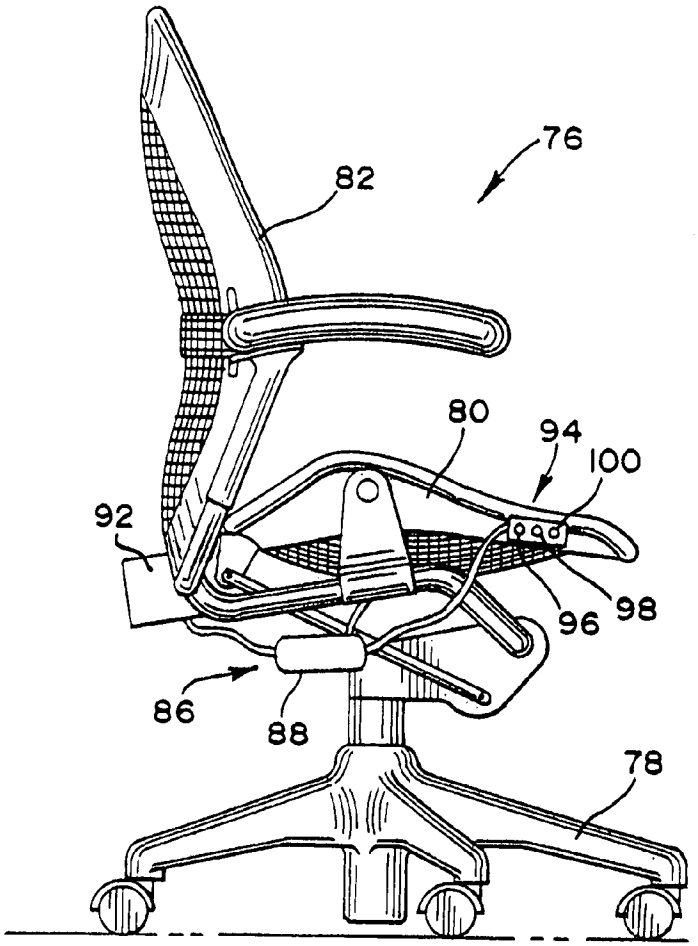
FIG. 18 shows a side view of the seating structure shown in FIG. 17.
Figure 17:
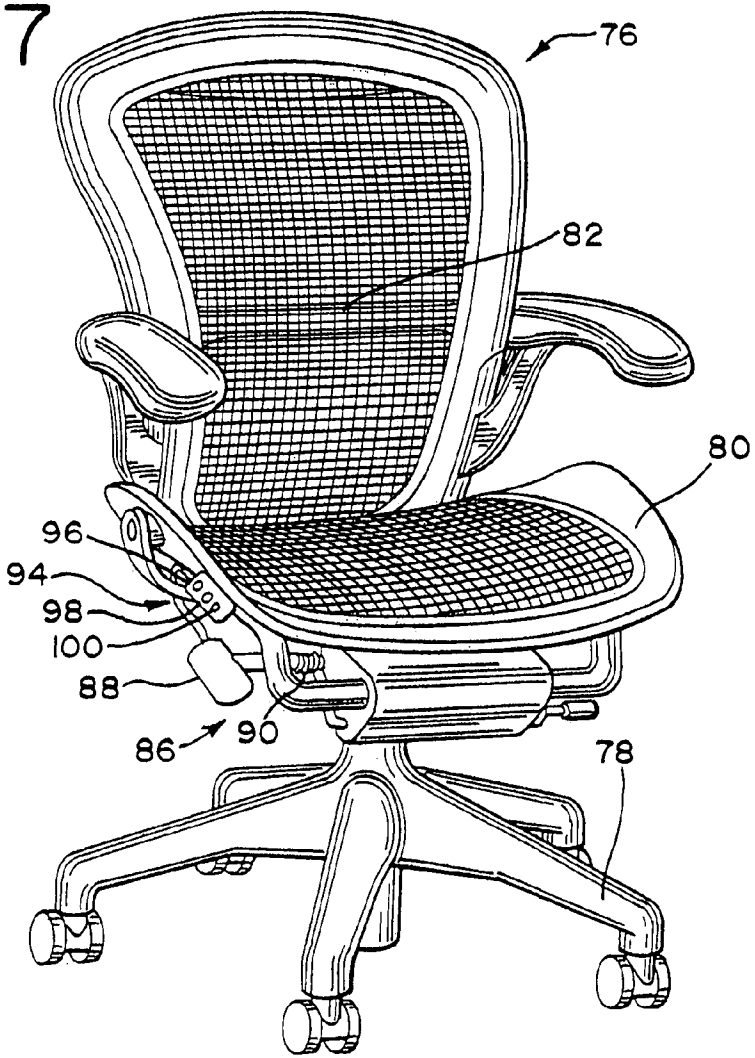
FIG. 17 shows a perspective front view of a seating structure embodying features of the present invention.
Figure 19:
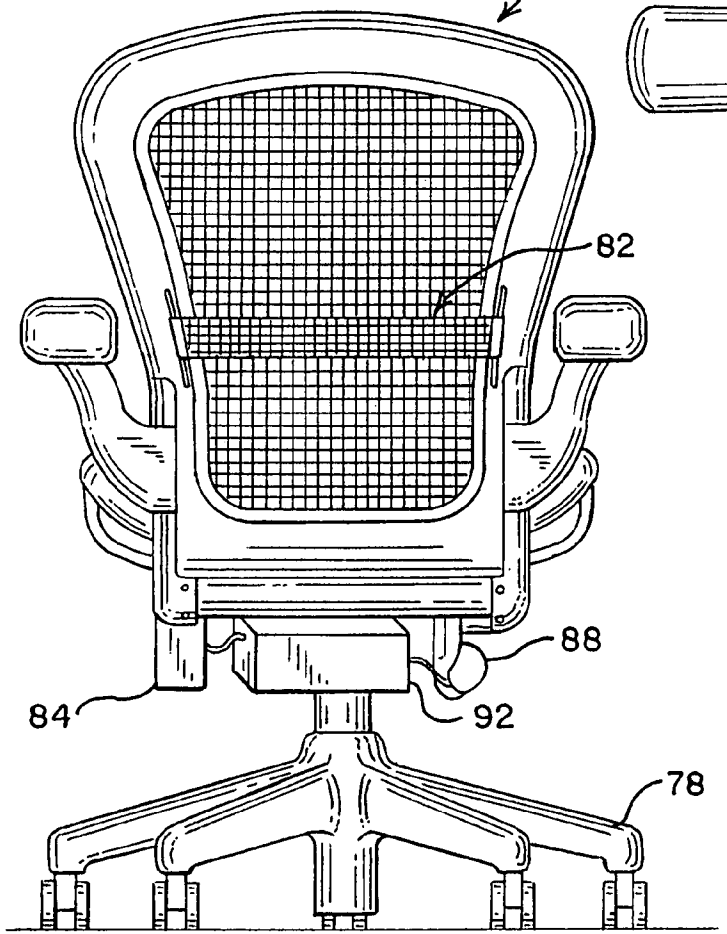
FIG. 19 shows a rear view of the seating structure shown in FIG. 17.

A seating structure embodying features of the present invention contains an electrical conduit electrically coupled to a power source, and one or more electrically powered devices coupled to the electrical conduit. FIGS. 17-19 show seating structure 76 in accordance with the present invention that includes a base 78, a seat 80 supported by the base 78, and a backrest 82 connected to the seat 80. Each of seat 80 and backrest 82 is desirably comprised of a form-fitting, breathable woven mesh material, such as that sold under the tradename PELLICLE® by Herman Miller.

The seating structure 76 shown in FIG. 18 further contains a power source 84 and a tilt adjustment mechanism 86. The tilt adjustment mechanism 86 preferably includes a motor 88, a spring 90 coupled to the motor 88, a microprocessor 92 electrically coupled to the motor 88, and a control system 94 electrically coupled to the motor 88. Preferably, the motor 88 is a reversible motor, such that spring 90 can be stretched or compressed (i.e., the tilt of seat 80 and/or backrest 82 can be increased or decreased) depending on whether motor 88 is operated in a forward or reverse direction. The direction of operation of motor 88 is controlled through touch-activated control system 94, whereby pressure applied to a first touch-sensitive region 96 activates motor 88 in a forward direction, pressure applied to a second touch-sensitive region 98 activates motor 88 in a reverse direction, and pressure applied to a third touch-sensitive region 100 deactivates motor 88.

It is to be understood that the location of elements shown in FIGS. 17-19 is merely representative, and that manifold alternative configurations lie within the scope of the present invention. For example, the control system 94 may be attached to an armrest of seating structure 76 or to some portion of the backrest 82, as opposed to a side of seat 80. Furthermore, it is to be understood that a seating structure embodying features of the present invention may include one or more alternative electrically powered devices in addition to or instead of the tilt adjustment mechanism 86 depicted in FIGS. 17-19. For example, the seating structure 76 may include an automatic tilt adjustment mechanism, whereby adjustments to the seat 80 and/or backrest 82 are made automatically based on the specific weight of an individual user, as described hereinabove.

Figure 20:
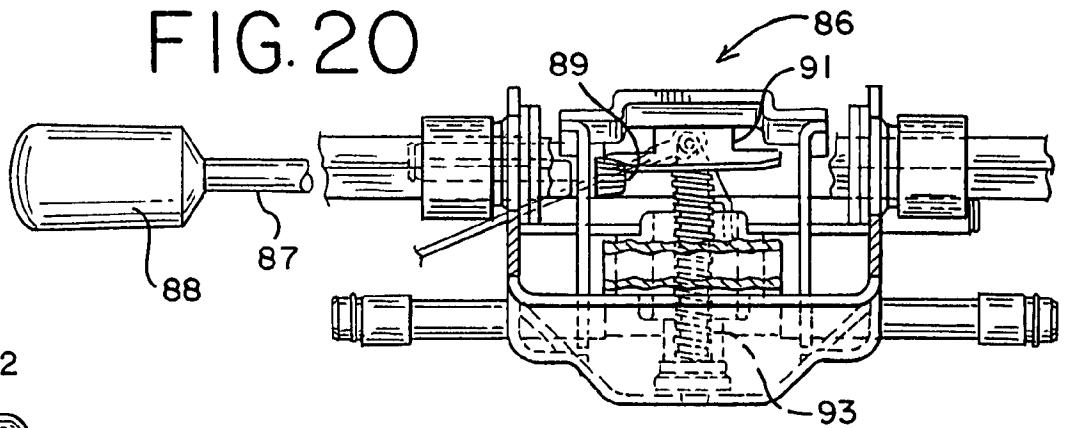
FIG. 20 shows a front view of the tilt adjustment mechanism shown in FIG. 17.
Figure 21:
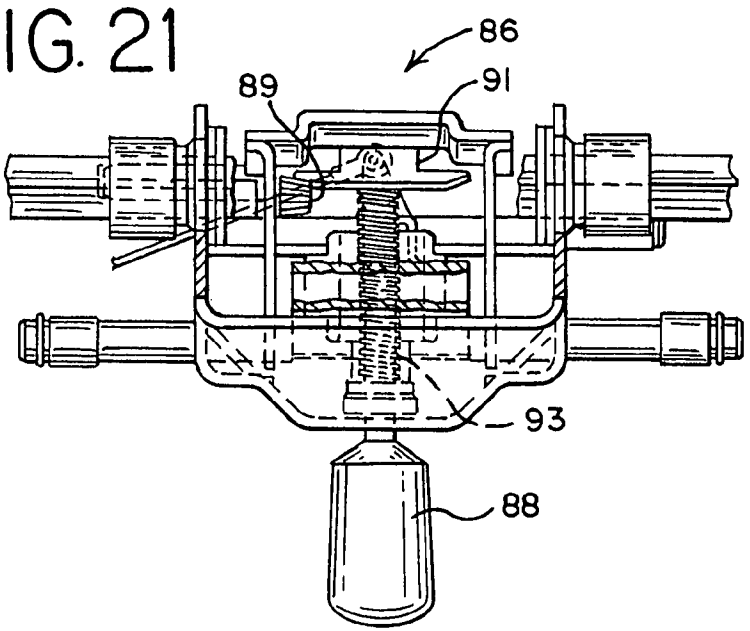
FIG. 21 shows a front view of an alternative tilt adjustment mechanism to the one shown in FIG. 20.

FIG. 20 shows a front view of the tilt adjustment mechanism 86. The motor 88 is connected to a shaft 87 that is connected in turn to a first bevel gear 89. The first bevel gear 89 meshes with a second bevel gear 91, such that when the first bevel gear 89 is turned by the agency of shaft 87, a screw 93 is turned, thereby modulating tilt. In an alternative embodiment, shown in FIG. 21, the motor 88 is connected directly to the screw 93, thereby facilitating concealment of motor 88 within a portion of base 78.

A method of using a chair embodying features of the present invention includes storing personalized chair settings on an encoded device, and reading the personalized chair settings using an electrically powered control system connected to the chair, which is configured to receive electricity generated by a fuel cell. The method optionally further includes one or more of automatically adjusting the chair to achieve the personalized chair settings (e.g., automatically adjusting chair tilt, automatically adjusting chair height, etc.), storing a plurality of personalized chair settings onto the encoded device, and automatically adjusting a plurality of chairs to achieve a plurality of personalized chair settings (which are the same or different).

The manner in which an office component embodying features of the present invention is made, and the process by which it is used, will be abundantly clear to one of ordinary skill in the art based upon a consideration of the preceding description. However, strictly for the purpose of illustration, a table is provided below (Table 1), which identifies representative manufacturers of representative components useful in accordance with the present invention. It is to be understood that a great variety of alternative components available from alternative manufactures are readily available and can be used in place of the ones identified.

TABLE 1

| Component | Supplier | Model | Description |
|---|---|---|---|
| Height Adjustment Motor | Generic | Generic | — |
| | Bosh | CHP | DC motor with a gear assembly. With a 52:2 reduction. 24 V/53 W |
| Tilt Adjustment Motor | Bosh | CEP | DC motor with a gear assembly. With a 79:1 reduction. 23 V/23 W |
| Position Transducer | Generic | Generic | — |
| Linear | Space Age | Series 100 | Analog output, 1 turn conductive plastic potentiometer. 1.5 in. max travel. |
| Rotational | Bei Dunca | Generic | Rotary sensors with resistive technology using wirewound & hybrid coils. |
| Fuel Cell | Generic | Generic | — |
| Battery | Dewalt | DW0240 | Rechargeable 24 V/240 W battery. Nickel and Cadmium. |
| Load Cell | Generic | Generic | — |
| Card Reader | Yuhina | ACR30 | Smart card reader/writer or Equivalent RS232 |
| Card | Siemens | SLE 4428 | Stores Positional Information. Good portability of data. Data can quickly be stored and loaded from the card. |
| Sound System | Cambridge | — | — |
| Speakers | Cambridge | — | — |
| Software | Cambridge | — | — |
| Patent Reference/ Cambridge | Cambridge | — | — |

The foregoing detailed description has been provided by way of explanation and illustration, and is not intended to limit the scope of the appended claims. Many variations in the presently preferred embodiments illustrated herein will be obvious to one of ordinary skill in the art, and remain within the scope of the appended claims and their equivalents.

The invention claimed is:

1. A seating structure comprising:

a base and a seat supported by the base;

a microprocessor;

an automatic tilt adjustment mechanism electrically coupled to the microprocessor;

a digital display electrically coupled to the microprocessor;

an encoded device reader electrically coupled to the microprocessor; and an encoded device writer electrically coupled to the microprocessor;

wherein the automatic tilt adjustment mechanism automatically adjusts tilt of the seat structure so that the seating structure conforms to personalized setting information stored on an encoded device that is read by the encoded device reader.

2. The seating structure of claim 1 further comprising a backrest connected to at least one of the seat and the base.

3. The seating structure of claim 1 further comprising a fuel cell electrically coupled to the microprocessor.

4. The seating structure of claim 1 further comprising an automatic height adjustment mechanism electrically coupled to the microprocessor.

5. The seating structure of claim 4 further comprising a fuel cell electrically coupled to the microprocessor.

6. The seating structure of claim 4 wherein the automatic height adjustment mechanism comprises:

a first motor electrically coupled to the microprocessor;

a gear rotatably connected to the motor, wherein the gear meshes with and rotates a rotatably adjustable nut, and wherein the rotatably adjustable nut is on a height-adjustable shaft connecting the seat to the base of the chair; and a load sensor electrically coupled to the microprocessor, wherein the load sensor detects degree to which a load on the seat is alleviated.

7. The seating structure of claim 6 further comprising a backrest connected to at least one of the seat and the base, wherein the automatic tilt adjustment mechanism comprises:

a second motor electrically coupled to the microprocessor;

a biasing member connected to the second motor, wherein the biasing member adjusts biasing force against at least one of the seat and the backrest;

a load sensor electrically coupled to the microprocessor; and a position transducer electrically coupled to the microprocessor; wherein the load sensor detects a weight on the seat;

the microprocessor calculates an optimum target position for the biasing member based on the weight detected by the load sensor;

the second motor adjusts the biasing member to achieve the optimum target position; and the position transducer senses positioning of the biasing member, and signals the microprocessor when the optimum target position is achieved.

8. The seating structure of claim 7 further comprising a fuel cell, which is electrically coupled to the microprocessor.

9. The seating structure of claim 7 wherein the digital display comprises a user interface selected from the group consisting of a touch screen, a keyboard, a keypad, a voice recognition system, and combinations thereof, whereby a user can adjust office component settings.

10. The seating structure of claim 7 further comprising a memory device electrically coupled to the microprocessors.

11. The seating structure of claim 10 further comprising a sound masking system electrically coupled to the microprocessor.

12. A seating structure comprising:

a base and a seat supported by the base;

a microprocessor;

means for automatic tilt adjustment electrically coupled to the microprocessor;

means for visual display electrically coupled to the microprocessor;

means for reading stored information electrically coupled to the microprocessor; and means for storing information electrically coupled to the microprocessor;

wherein the means for automatic tilt adjustment automatically adjusts tilt of the seating structure so that the seating structure conforms to the stored information.

13. The seating structure of claim 12 further comprising a backrest connected to at least one of the seat and the base.

14. The seating structure of claim 12 further comprising a fuel cell electrically coupled to the microprocessor.

15. The seating structure of claim 12 further comprising means for automatic height adjustment electrically coupled to the microprocessor.

16. The seating structure of claim 15 further comprising a fuel cell electrically coupled to the microprocessor.

17. The invention seating structure of claim 12 wherein the means for visual display comprise a user interface selected from the group consisting of a touch screen, a keyboard, a keypad, a voice recognition system, switches, sensors, and combinations thereof, whereby a user can adjust office component settings.

18. The seating structure of claim 17 further comprising means for sound masking electrically coupled to the microprocessor.

* * * * *